US006823692B1

(12) United States Patent
Patel et al.

(10) Patent No.: US 6,823,692 B1
(45) Date of Patent: Nov. 30, 2004

(54) CARBON DIOXIDE REDUCTION SCHEME FOR NGL PROCESSES

(75) Inventors: Sanjiv Patel, Sugar Land, TX (US); Justin Pan, Houston, TX (US); Jorge Foglietta, Missouri City, TX (US)

(73) Assignee: ABB Lummus Global Inc., Houston, TX (US)

( * ) Notice: Subject to any disclaimer, the term of this patent is extended or adjusted under 35 U.S.C. 154(b) by 0 days.

(21) Appl. No.: 10/364,073

(22) Filed: Feb. 11, 2003

Related U.S. Application Data

(60) Provisional application No. 60/356,102, filed on Feb. 11, 2002.

(51) Int. Cl.[7] ..... F25J 3/00
(52) U.S. Cl. ..... 62/620; 62/929
(58) Field of Search ..... 62/620, 617, 929

(56) References Cited

U.S. PATENT DOCUMENTS 4,171,964 A * 10/1979 Campbell et al. ..... 62/621
4,185,978 A 1/1980 McGalliard et al.
4,278,457 A 7/1981 Campbell et al.
4,851,020 A 7/1989 Montgomery, IV
5,291,736 A 3/1994 Paradowski
5,335,504 A 8/1994 Durr et al.
5,555,748 A 9/1996 Campbell et al.
5,566,554 A 10/1996 Vijayaraghavan
5,615,561 A * 4/1997 Houshmand et al. ..... 62/611
5,771,712 A 6/1998 Campbell et al.
5,799,507 A 9/1998 Wilkinson et al.
5,953,935 A 9/1999 Sorensen
5,960,644 A 10/1999 Nagelvoort et al.
5,992,175 A 11/1999 Yao et al.
6,109,061 A 8/2000 Gaskin
6,112,549 A 9/2000 Yao et al.
6,182,469 B1 2/2001 Campbell et al.
6,425,266 B1 7/2002 Roberts

* cited by examiner

*Primary Examiner*—Willaim C. Doerrler
(74) *Attorney, Agent, or Firm*—Bracewell & Patterson LLP

(57) ABSTRACT

An ethane recovery process resulting in a reduction in the amount of carbon dioxide in the recovered NGL stream is provided. To reduce the amount of carbon dioxide, a fractionation tower is provided with a bottom reboiler, and possibly one or more side reboilers higher up in the tower that are integrated with the cooling train. The process disclosed modifies the flow of cold liquid from the separator and tower reboiling to reject some of the more volatile components such as carbon dioxide from the less volatile fraction while maintaining recovery of desirable components such as C2+ hydrocarbon components. The modification includes heating a part of the separator liquid and introducing it at least one stage below the remaining liquid.

40 Claims, 9 Drawing Sheets

CARBON DIOXIDE REDUCTION SCHEME FOR NGL PROCESSES

RELATED APPLICATIONS

This application claims the benefit of a provisional application having U.S. Ser. No. 60/356,102, filed on Feb. 11, 2002, which hereby is incorporated by reference in its entirety.

BACKGROUND OF THE INVENTION

1. Technical Field

The present invention relates to natural gas liquid (NGL) processes. More particularly, this invention relates to reducing the amount of carbon dioxide ($CO_2$) recovered with NGL during cryogenic processing.

2. Description of Prior Art

Natural gas and refinery off gas streams generally contain more volatile components such as hydrogen, methane, carbon monoxide, $CO_2$, nitrogen and heavier hydrocarbon components such as ethane, ethylene, propane, propylene, and other heavier components. The amount of these components present depends on the source of the feed gas. Recovery of ethane and ethylene from natural gas and refinery off gas streams is a common hydrocarbon recovery process. However, along with the ethane and ethylene, a significant amount of the more volatile components, such as $CO_2$, in the feed stream will also be recovered with NGL in this process. Pipelines generally have a maximum allowable amount of $CO_2$ that is permissible in NGL. As a result of this, recovered $CO_2$ may need to be removed with downstream equipment to meet the $CO_2$ specification limits in the NGL. The additional equipment required to remove the $CO_2$ adds considerable capital and operating costs to the process.

In order to reduce the amount of CO2 contained in the NGL stream, CO2 needs to be extracted from the NGL stream by treating it with an amine. Once the CO2 is removed, it is typically vented to the atmosphere. The amine system needed to treat the NGL stream will need a significant amount of fuel to regenerate itself, which sends even more CO2 to be vented to the atmosphere. If the NGL recovery plant is producing liquid hydrocarbon that is to be used by a petrochemical plant, the ethane from the NGL is fractionated out and treated for CO2 removal. Again, the treating is done by amines, and leads to significant excess CO2 venting to atmosphere.

As an alternative method of CO2 reduction, the feed gas can be treated to reduce the amount of CO2 in the feedstream, which will in turn reduce the amount that is recovered with the NGL during cryogenic processing. However, pretreating the feed gas stream also adds considerable costs to the overall NGL process.

In many NGL recovery processes, there is little control over the amount of $CO_2$ that is recovered with the NGL. If higher C2 recovery is desired, NGL will contain more CO2. In order to reduce the amount of CO2 in NGL, the fractionation tower used in the process needs to be reboiled more. The increased reboiler activity in turn will lead to some loss of desirable components, such as ethane and ethylene, or a loss of process efficiency if the same recovery is maintained.

In a typical turbo expander plant, feed gas is treated to remove impurities such as water, mercury, etc. and then sent for hydrocarbon recovery. If the feed gas pressure is not high enough, compression of the feed gas may be utilized. Gas entering the cryogenic section of the plant is first cooled in one or more exchangers to at least partially condense the gas. The two-phase stream is then sent to a cold separator to separate the vapor from the liquid. For an ethane and heavier compound ("C2+") recovery process, the liquid stream is expanded and sent to a fractionation tower, while the vapor stream is expanded with a work expansion device, such as a turbo expander, and sent to the fractionation tower as an upper tower feed stream. A bottom reboiler is provided for the fractionation tower to control the amount of lighter components exiting the bottom of the fractionation tower with desirable C2+ components. One or more side reboilers are added to the fractionation tower to increase efficiency of cross exchange. The overhead of the fractionation tower is the cold residue gas, which essentially contains the lighter components in the feed gas. Residue stream is preheated in the cross exchanger train and then sent for further processing. Further processing could include compression and cooling of the gas to the desired pressure and temperature.

For a high C2 recovery process, a reflux stream is required above the expander outlet feed location in the fractionation tower to recover some of the C2+ components that are leaving the top of the tower. Several sources for a reflux stream can be used. One source can be at least a portion of the warmed and compressed residue gas. A part of this high-pressure residue gas is cooled in the chilling train and substantially condensed. This condensed stream, which is lean in C2+ components, is fed above the expander outlet feed of the fractionation tower. Such a process is able to recover well in excess of 95% of the C2+ components. An alternate source of a reflux stream can be at least a portion of the vapor stream being sent to the expander. This stream is condensed under pressure and sent as a top feed stream to the fractionation tower. Such a process can produce C2+ recovery in the low to middle 90's %. Yet another source for a reflux stream is to take at least a portion of the expander feed gas and partially condense it. This condensed stream is sent at a lower location in the fractionation tower, while the vapor stream that is leaner in C2+ components than the expander feed stream is condensed under pressure and sent as top feed to the fractionation tower. Such a process can produce C2 recovery in the middle 90's %.

Several new processes have been developed in recent years that use multiple reflux streams above the expander outlet feed location in the fractionation tower. These processes generate streams of various C2+ richness levels and use them at different locations in the fractionation tower to increase ethane recovery and efficiency of the process. These multiple reflux processes are capable of C2 recovery well in excess of 95%.

Not only is recovery of NGL an issue, but the removal of other components from either the NGL stream or the residue gas is also important. An example process in which CO2 is removed from the residue gas stream can be found in U.S. Pat. No. 5,960,644 issued to Nagelvoort et al. In Nagelvoort, natural gas is condensed and then separated into a liquid stream and a vapor stream. The vapor stream is sent to a fractionation tower and the liquid stream is also sent to the tower below the vapor stream. A stream taken from the tower, reboiled, and returned to the tower at location below the liquid stream feed location. The tower produces an overhead stream, which is condensed and separated. The resulting liquid stream is refluxed back to the tower at a higher location than the vapor stream feed location. The resulting vapor is condensed and separated again. The resulting liquid stream is refluxed back to the tower as a second reflux stream at a higher location than the first reflux stream. This process removes the CO2 from vapors and refluxes the CO2 back into the column. Ultimately, the tower bottoms liquid stream contains the majority of CO2, which has to be removed with further processing, and the residue gas stream is relatively free of CO2.

Others have developed processes to try to reduce the amount of CO2 contained within the NGL liquids that are recovered from natural gas streams. An example can be found in U.S. Pat. No. 4,185,978 issued to McGalliard et al. In this process, a hydrocarbon feed gas is expanded, separated, and sent to a demethanizer tower. The demethanizer tower produces an overhead stream containing essentially all of the methane and gaseous CO2 and a bottoms stream containing essentially all of the liquid ethane and heavier components, along with non-gaseous CO2 dissolved in the liquid stream. To remove the CO2 from the liquid stream, an external inert sweep gas is injected into the liquid stream as a stripping gas. This stripping gas helps regulate the reboiler temperatures to reduce temperature fluctuations within the tower that can lead to significant swings in the amount of CO2 that is recovered in the NGL liquid streams.

A need exists for a more economical and efficient method of reducing the amount of $CO_2$ that is recovered in the NGL cryogenic processes. A need also exists for a process to NGL streams with reduced amounts of CO2 in the NGL stream, as opposed to processing the stream further to remove CO2. A further need exists for a method of reducing CO2 in NGL streams without having to add additional chemicals, which increases the operating costs of the process. It is an object and goal to provide a process and apparatus to reduce the amount of $CO_2$ recovered in the NGL product. It is an additional object and goal to improve ethane recovery in the NGL product when $CO_2$ recovery is maintained.

SUMMARY OF THE INVENTION

The present invention includes a process and apparatus for reducing the amount of $CO_2$ that is recovered in a NGL product stream. The invention can also be used to increase the amount of ethane and ethylene recovery in the NGL product stream, while maintaining the same amount of $CO_2$ in the NGL product stream. In this process, a cold separator is used to separate the feed into a first liquid stream and a first vapor stream. The first liquid stream is then divided into two streams, a second liquid stream and a third liquid stream. The third liquid stream is heated and supplied to a fractionation tower as a stripping gas at a point below the other feed streams. The stripping gas strips the $CO_2$ from the liquids falling down the tower. The result of this stripping mechanism is reduced $CO_2$ in the NGL product stream or increased ethane and ethylene recovery with maintained $CO_2$ recovery levels.

The present invention is applicable for the separation of ethane, ethylene, propane propylene and other C3 components and heavier components from the above mentioned feed gases using cryogenic turbo expander process. The present invention can be modified to use two separate towers, an absorber tower and a fractionation tower. Other variations can be used, such as a split vapor feed stream and using a portion of a residue gas stream as a reflux stream in the fractionation tower.

The apparatus preferably includes an inlet heat exchanger, an expander, a fractionation tower, at least one side reboiler, and a splitter for splitting the first liquid stream to provide a stripping gas for the fractionation tower. An absorber tower can also be used, as described herein.

BRIEF DESCRIPTION OF THE DRAWINGS

So that the manner in which the features, advantages and objects of the invention, as well as others that will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION OF THE DRAWINGS

Figure 1:
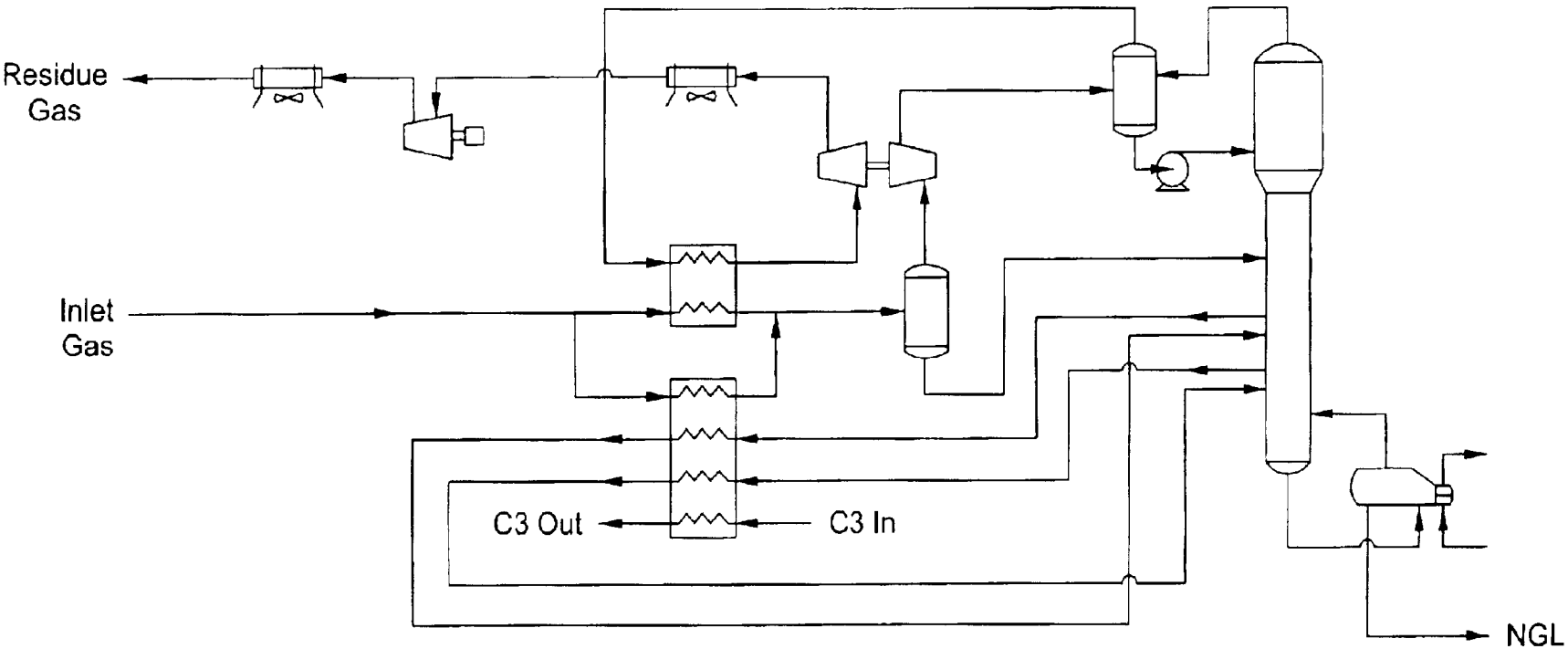
Fig. 1 (Prior Art)
FIG. 1 is a simplified flow diagram of a cryogenic gas separation utilizing a basic expander scheme without any reflux to a fractionation tower in accordance with prior art processes.

Numerous configurations exist for ethane recovery processes in the prior art. FIG. 1 is one such example of a moderate ethane recovery process. This process shown in FIG. 1 does not make use of a reflux stream for the fractionation tower. Feed gas to the plant is processed in the front end of the plant to remove water and other contaminants, such as mercury, that are detrimental to the performance of the cryogenic plant. Clean, dry, and filtered feed gas is split into two streams. The larger of the two streams cross exchanges with cold residue gas, while the smaller stream cross exchanges with cold liquid from the fractionation tower. Additional refrigeration may be used in the form of external mechanical refrigeration if required. The two partially condensed feed streams are mixed and sent to a cold separator for phase separation. Liquid from the cold separator is sent directly to the fractionation tower, while vapor is expanded through a turbo expander by isentropic expansion thereby cooling it. The cooled and partially condensed gas is sent to the expander outlet separator. Liquid from the expander outlet separator is pumped to the fractionation tower as a top tower feed stream. The fractionation tower produces a tower bottoms stream that contains a less volatile fraction of the inlet gas containing ethane, ethylene, propane, propylene and heavier hydrocarbon components. The overhead of the fractionation tower produces the more volatile components such as methane, CO2, etc. The more volatile gas leaving the tower is routed to the expander outlet separator. Gas leaving the expander outlet separator is residue gas that is preheated in the inlet gas exchanger and sent to the booster compressor where its pressure is raised. This gas is then compressed further to a pressure sufficient to inject it into a lean gas pipeline.

Figure 3:
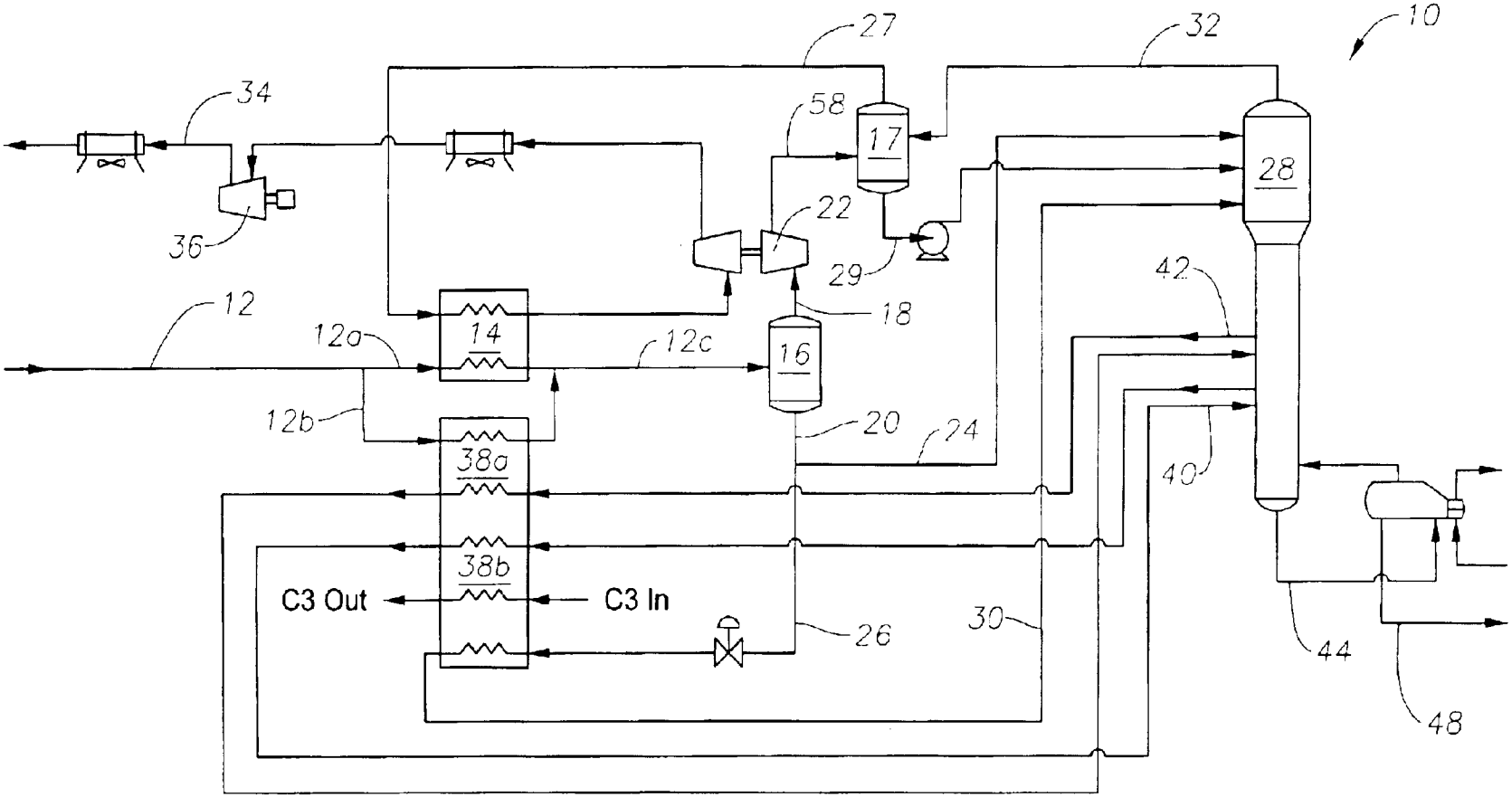
FIG. 3 is a simplified flow diagram of a cryogenic gas separation process utilizing an expander scheme according to an embodiment of the present invention.

FIG. 3 illustrates an embodiment of the present invention that is similar to the prior art process of FIG. 1, but incorporates the present invention within the process. Table 1 lists some of the key parameters from a computer simulation comparing the two processes. The specifics of the process shown in FIG. 3 will be described in greater detail herein.

TABLE 1

SIMULATION RESULTS FOR FIGS. 1 AND 3

| | FIG. 1 | FIG. 3 |
|---|---|---|
| Plant Feed (MMSCFD) | 1062 | 1062 |
| Feed Temperature (° F.) | 68 | 68 |
| Feed Pressure (psia) | 607.7 | 607.7 |
| Feed Composition (mol %) | | |
| C1 | 93.68 | 93.68 |
| C2 | 3.247 | 3.247 |
| C3+ | 1.069 | 1.069 |
| CO2 | 1 | 1 |
| N2 | 1.004 | 1.004 |
| NGL Product (BPD) | 25940 | 25310 |
| NGL Composition (mol %) | | |
| C1 | 1.22 | 1.29 |
| C2 | 61.04 | 64.46 |
| C3+ | 26.84 | 28.25 |
| CO2 | 10.9 | 6 |
| C2 Recovery (%) | 73.73 | 74.52 |
| Ton/day | 414.29 | 418.76 |
| CO2 Recovery (%) | 42.8 | 22.53 |
| Ton/day | 108.32 | 57.01 |
| C3 Recovery (%) | 97.71 | 98.78 |
| Ton/day | 185.82 | 187.85 |
| C4+ Recovery Ton/day | 112.42 | 112.51 |
| Residue Compression, hp | 40924 | 42573 |
| Cold Separator Temp (° F.) | −110.6 | −118.5 |
| Frac. Tower Ovhd Temp (° F.) | −146.3 | −139.3 |
| Frac. Tower Ovhd Pressure (psia) | 321 | 305 |

As shown in Table 1, for a slight increase of 4% in the residue compression requirements, there is a 47.4% drop in the amount of CO2 that is recovered in the NGL stream. In addition, there is a slight increase in C2 and C3+ recovery. The increase in residue compression is well within the capabilities of the electric motor driven residue compressors. When the present invention is applied to existing plants, constraints may exist that limit the rejection of CO2. For a new plant, CO2 rejection could be higher. FIG. 3 shows the improvements of the new invention applied to the above process. The modification involves taking a part of the cold separator liquid, flashing it preferably across a valve, and then preheating it, preferably by heat exchange contact with at least a portion of the feed gas stream. The partially vaporized stream would normally be sent towards the bottom of the tower. However, in this case, the new process was being applied to an existing plant, where the flexibility of adding or moving feed locations or changing the diameter of the tower may not be possible. FIG. 3 shows the new routing of the feed streams on an existing facility. The improvement of the present invention used on an existing plant worked well enough to significantly reduce the amount of CO2 in the NGL product.

Figure 2:
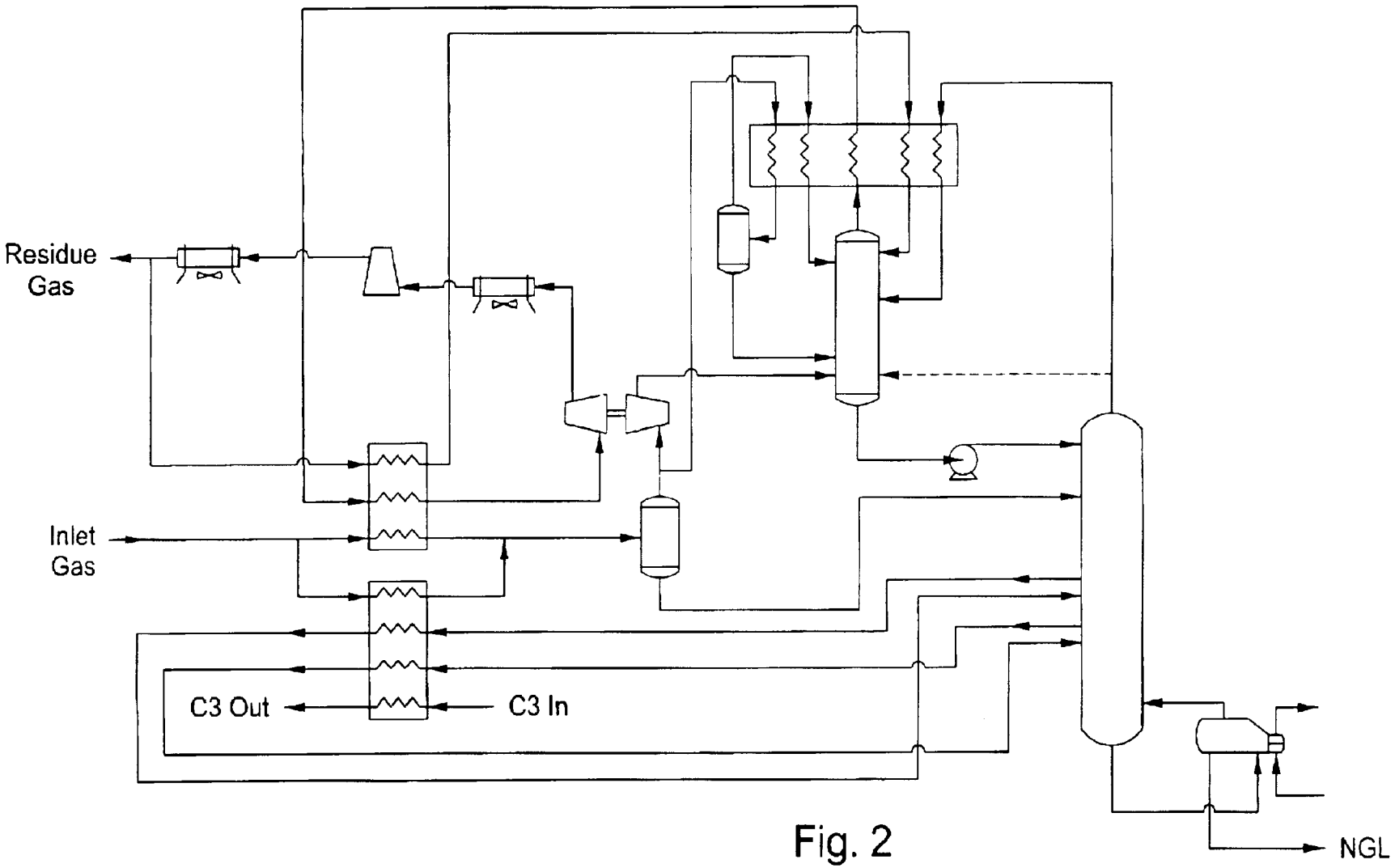
Fig. 2 (Prior Art)
FIG. 2 is a simplified flow diagram illustrating a cryogenic gas separation process utilizing a two tower, multiple reflux scheme in accordance with copending U.S. Provisional Patent Application Ser. No. 60/440,538.

FIG. 2 illustrates a two-tower, multiple reflux process scheme that can be used in ethane recovery processes, with a recovery rate of about 85% ethane. The process shown in FIG. 2 has a potential recovery rate of about 95%. Such a scheme splits the conventional demethanizer tower into two separate vessels, an absorber tower and a fractionation tower. The advantage of such a scheme is that it maintains efficiency during ethane recovery mode of operation, but can easily by converted to high propane recovery operation while still maintaining efficiency. Use of two towers, along with the use of multiple reflux streams, is more fully described in copending U.S. Provisional Patent Application Ser. No. 60/440,538. In this two-tower process, liquid from the cold separator is expanded, preferably across a control valve, and sent to the fractionation tower, preferably as a middle feed stream. Vapor from the cold separator is split into two streams. The larger of the two streams is sent to a turbo expander where gas pressure is reduced by isentropic expansion. Such an expansion not only lowers the gas pressure, but also extracts work, thereby cooling and partially condensing the gas. This cooled and partially condensed gas is routed to the bottom of the absorber tower. The smaller cold separator vapor stream is partially condensed against cold residue gas and then sent to a flash separator for phase separation. The liquid separated from the flash separator is sent to the bottom of the absorber tower, while the lean gas leaving the flash separator is condensed under pressure expanded across a control valve and sent, preferably as a middle feed stream, to the absorber tower. The absorber tower preferably is a multi feed tower that produces a lean residue gas as an absorber overhead stream and a cold hydrocarbon liquid as an absorber bottoms stream. Liquid leaving the absorber is pumped to the fractionation tower, preferably as a top feed stream. Absorber overhead stream is preheated by cross exchange with warm streams and then boosted in pressure in the expander booster compressor to form a residue gas stream. The medium pressure residue gas is then sent to the residue compressors where its pressure is raised to the pipeline pressure. A part of this high-pressure residue gas is cooled, condensed under pressure and sent as top feed to the absorber.

The fractionation tower is a reboiled tower that produces a NGL product stream that contains C2+ components at the bottom of the fractionation tower. The overhead of the tower is lean gas, which is condensed as much as possible and sent as lower feed for the absorber or, alternatively, directly routed to the bottom of the absorber tower. The fractionation tower is preferably provided with a bottom reboiler and at least one side reboiler. The location and duties of these exchangers are selected to maximize heat integration with hot streams. Table 2 shown below lists simulation results.

TABLE 2

SIMULATION RESULTS FOR FIG. 2

| | INLET GAS STREAM | NGL PRODUCT STREAM |
|---|---|---|
| Flow | 734.9 MMSCFD | 73941 SBPD |
| C2 (mol %) | 7.633 | 43.35 |
| (ton/day) | 2016.07 | 1714.1 |
| C3 (mol %) | 3.968 | 26.41 |
| (ton/day) | 1537 | 1531.6 |
| CO2 (mol %) | 1.5 | 3.51 |
| (ton/day) | 580.03 | 203.06 |
| Residue comp (hp) | 36911 | |
| C3 refrig (mmbtu/hr) | 21.6 | |
| Plate Fin UA (BtU/F-hr) | 2.29E+07 | |
| C2 Recovery (%) | 85 | |
| C3 Recovery (%) | 99.65 | |
| CO2 Recovery (%) | 35 | |

Figure 9:
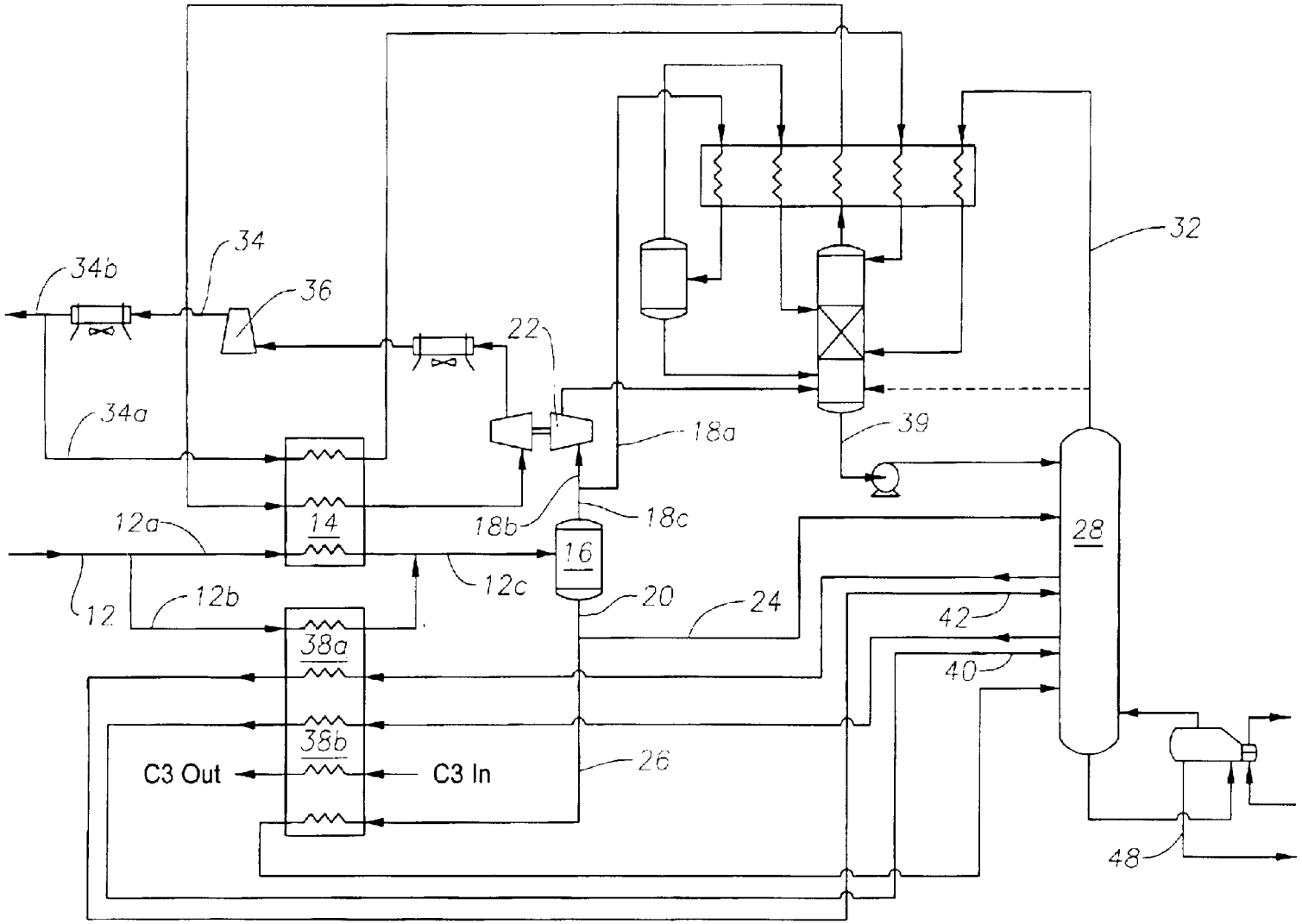
FIG. 9 is a simplified flow diagram of a cryogenic gas separation process that utilizes multiple reflux stream and dual tower scheme according to one embodiment of the present invention.

As shown in Table 2, there is significant recovery of CO2 in the NGL product, which will need to be removed by downstream processing. The process of FIG. 2 can be modified in accordance with the present invention, as shown in FIG. 9, to recover less CO2 in the tower bottoms stream, while maintaining ethane and propane recovery in the residue gas stream.

FIG. 3 illustrates one embodiment of the $CO_2$ reduction scheme for NGL processes 10 in accordance with the present invention. The feed gas stream 12 is first sent through dehydration and inlet processing (not shown). Feed gas stream 12 is then split into two streams, 12*a* and 12*b*. Stream 12*a* is cooled by heat exchange contact with other process streams in a front-end exchanger 14. In all embodiments of the present invention, front-end exchanger 14 can be a single multi-path exchanger, a plurality of individual heat exchangers, or combinations thereof. The cooled feed gas stream 12*a* is recombined with stream 12*b* as combined feed stream 12*c*. The combined feed stream 12*c* then goes to one or more cold separator(s) 16 or absorbers where a vapor stream 18 and a liquid stream 20 are produced as a result of separating the combined feed stream 12*c*.

Vapor stream 18 is sent to an expander 22. Expander 22 can be any type of device resulting in expansion known by one skilled in the art. From expander 22, vapor stream 58 is fed to another separator 17 that separates the first vapor stream 58 into a separator overhead stream 27 and a separator bottoms stream 29. Separator bottoms stream 29 is sent to a tower 28. Tower 28 can be any type of device resulting in transferring materials from a liquid phase to a vapor phase. For example, a demethanizer tower would be an acceptable choice for this invention.

One of the improvements in all embodiments of the present invention over prior art processes is the split of first liquid stream 20. First liquid stream 20 is split into two streams, second liquid stream 24 and third liquid stream 26. Splitting liquid stream 20 allows part of the liquid stream 20 to be heated to produce stripping vapors for $CO_2$ reduction. The stripping vapors strip CO2 from the liquids flowing down the tower to reduce the amount of CO2 that actually reaches the bottom of tower 28. Second liquid stream 24 is sent to tower 28. Third liquid stream 26 is heated, preferably in inlet exchanger 14 by heat exchange contact with at least a portion of inlet gas stream 12*b*, wherein at least a portion of third liquid stream 26 is vaporized, producing a warmed stream 30. To assist in the reduction of the amount of CO2 recovered in the NGL stream, the feed stream conditions are maintained by maintaining any adequate quantity and temperature of third liquid stream 26 and by controlling the amount of reboiling in tower 28.

Third liquid stream 26 can also be heated by heat exchange contact with at least one tower reboiler stream 40. Tower reboiler stream 40 is preferably removed from tower 28 at a removal location and is returned at a return location that is located essentially at a same theoretical stage or slightly lower within tower 28 as the removal location.

Warmed stream 30 is also sent to tower 28, and is fed one or more stages below where second liquid stream 24 was fed to tower 28. Since warmed stream 30 contains vapors, stream 30 strips $CO_2$ from the liquid running down the tower 28. The stripped $CO_2$ rises with the vapors rising through tower 28 and exits the top of tower 28 as tower overhead stream 32.

In a preferred embodiment, at least a portion of feed stream 12 is at least partially condensed in front end exchanger 14 by heat exchange contact with at least separator overhead stream 27. Separator overhead stream 27 is removed as a residue gas stream 34. Such residue gas stream 34 is then compressed to pipeline specifications by a booster compressor 36.

In one embodiment, at least a portion of gas feed stream 12 can be supplied as split feed stream 12*b*, which is used to provide heat to side reboilers 38*a*, 38*b* of tower 28 and is cooled and at least partially condensed thereby. Stream 12*b* can also be cooled by heat exchange contact with the third liquid stream 26. Stream 12*b* is first supplied to side reboiler 38*b* for heat exchange contact with liquid condensate 40 that is removed from the lower half of the tower 28. Liquid condensate 40 is thereby warmed and redirected back to tower 28. Stream 12*b* is then supplied to side reboiler 38*a* for heat exchange contact with liquid condensate 42 that is removed from the lower half of the tower 28. Liquid condensate 42 is thereby warmed and redirected back to tower 28. Stream 12*b* is then cooled and at least partially condensed and then recombined with cooled stream 12*a* as combined stream 12*c*. The combined stream 12*c* is supplied to cold separator 16, which separates the combined stream 12*c*, as described above.

The desired NGL product is taken from the bottoms of the tower 28 as bottoms stream 44. Bottoms stream 48 can be pumped to the desired product storage facilities through the use of a bottoms pump 46 (not shown). By utilizing the present invention, the amount of $CO_2$ that is recovered in the NGL product stream 48 will be significantly reduced. Alternatively, the recovery of ethane and ethylene can be slightly increased, while maintaining approximately the same amount of $CO_2$ that is recovered in the NGL product stream 48.

The process disclosed here produces a NGL stream that is significantly lower in CO2, while still maintaining the recovery of C2+ components. Residue gas produced will contain essentially all the higher volatile components as well as the CO2 that is rejected from the NGL. The invention can be used for new plant designs, or can be used to retrofit existing plants.

Figure 5:
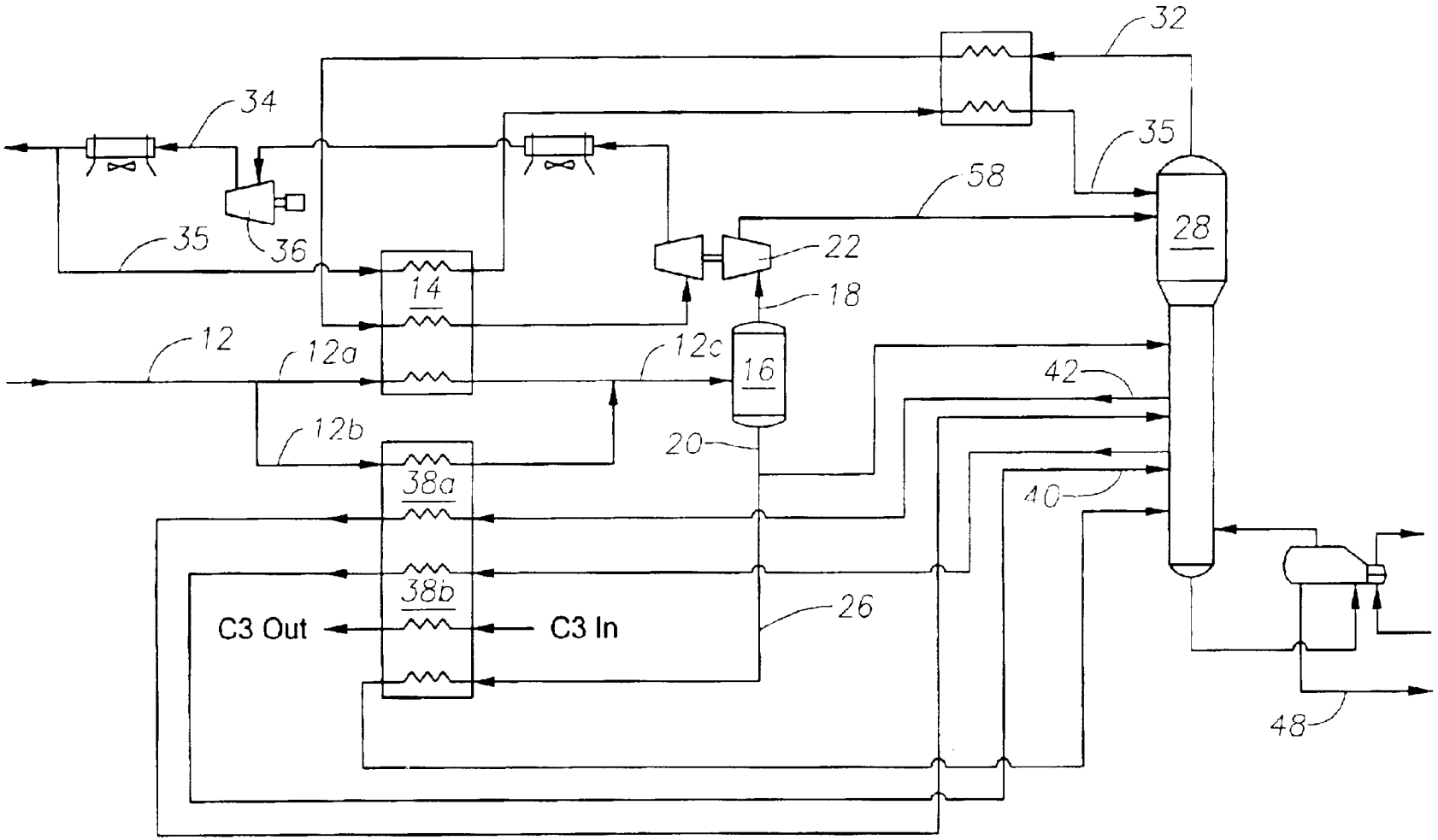
FIG. 5 is a simplified flow diagram of a cryogenic gas separation process utilizing a single tower with a single reflux stream scheme, with the reflux stream being taken as a portion of a residue gas stream, according to an embodiment of the present invention.

The process shown in FIG. 5 exemplifies another embodiment of the present invention. This process embodiment is similar to the process shown in FIG. 3, but with the addition of a tower reflux stream 35 taken from the residue gas stream 34. The source of the residue gas stream 34 is also different in this embodiment. From expander 22, vapor stream 58 is fed to tower 28, instead of expander outlet separator 17. Tower overhead stream 32 is heated and then compressed to pipeline specifications by a booster compressor 36. At least a portion of the residue gas stream 34 is removed and cooled to substantially condense stream 35. At least a portion of the residue gas stream 34 is supplied to tower 28, preferably as a top tower feed stream.

Figure 4:
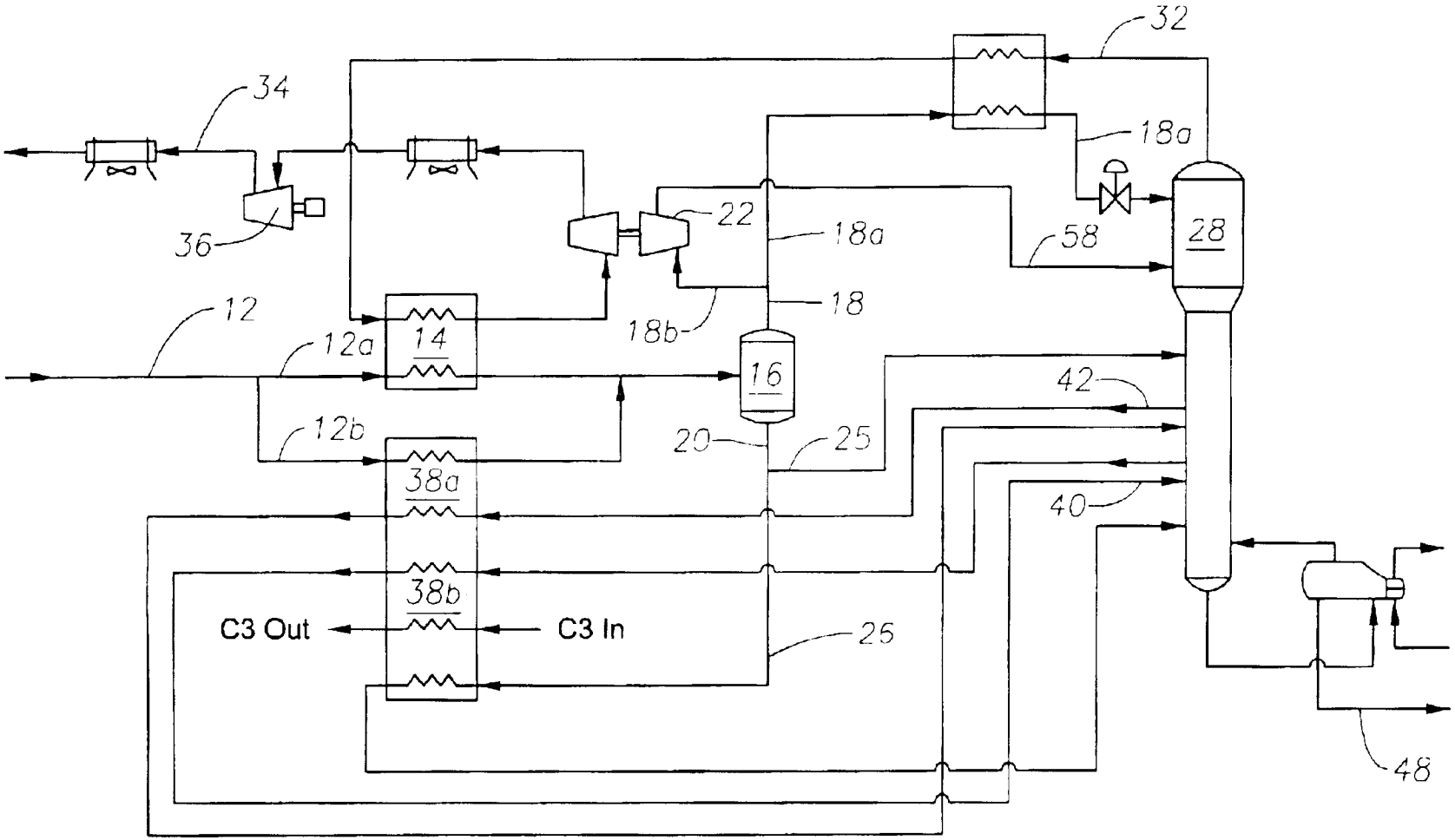
FIG. 4 is a simplified flow diagram of a cryogenic gas separation process utilizing an expander with a split vapor stream and a single tower with a single reflux stream scheme according to an embodiment of the present invention.

Another embodiment of the present invention is advantageously provided and illustrated in FIG. 4. In this process embodiment, reflux is provided for tower 28 by taking a portion of first vapor stream 18 and sending to tower 28 as a reflux stream. First vapor stream 18 is divided into two streams, a second vapor stream 18*a* and a third vapor stream 18*b*. Second vapor stream 18*a* is cooled, expanded and then sent to tower 28. Third vapor stream 18*b* is expanded and sent to tower 28 below the second vapor stream 18*a*.

Figure 6:
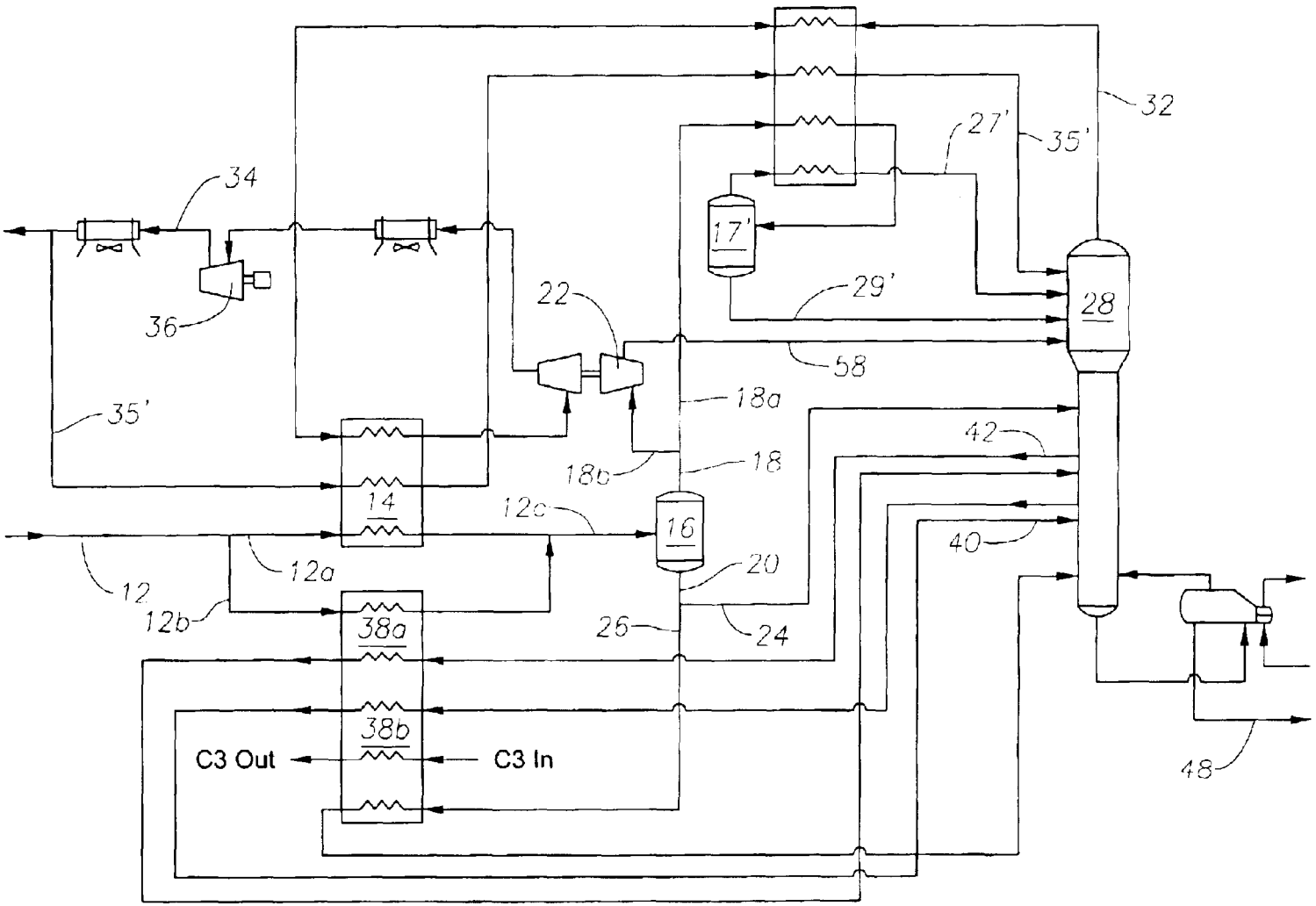
FIG. 6 is a simplified flow diagram of a cryogenic gas separation process utilizing a single tower expander scheme with the tower having multiple reflux streams according to an embodiment of the present invention.

FIG. 6 illustrates another process used to recover ethane in accordance with the present invention. In this embodiment, a flash separator 17' is used that receives the second vapor stream 18*a* and separates the stream into separator overhead stream 27' and separator bottoms stream 29'. Separator overhead stream 27' is cooled and then sent to tower 28. Tower overhead stream 32 is heated and compressed to form residue gas stream 34. At least a portion of residue gas stream is returned to tower 28 as a reflux stream 35'.

Figure 7:
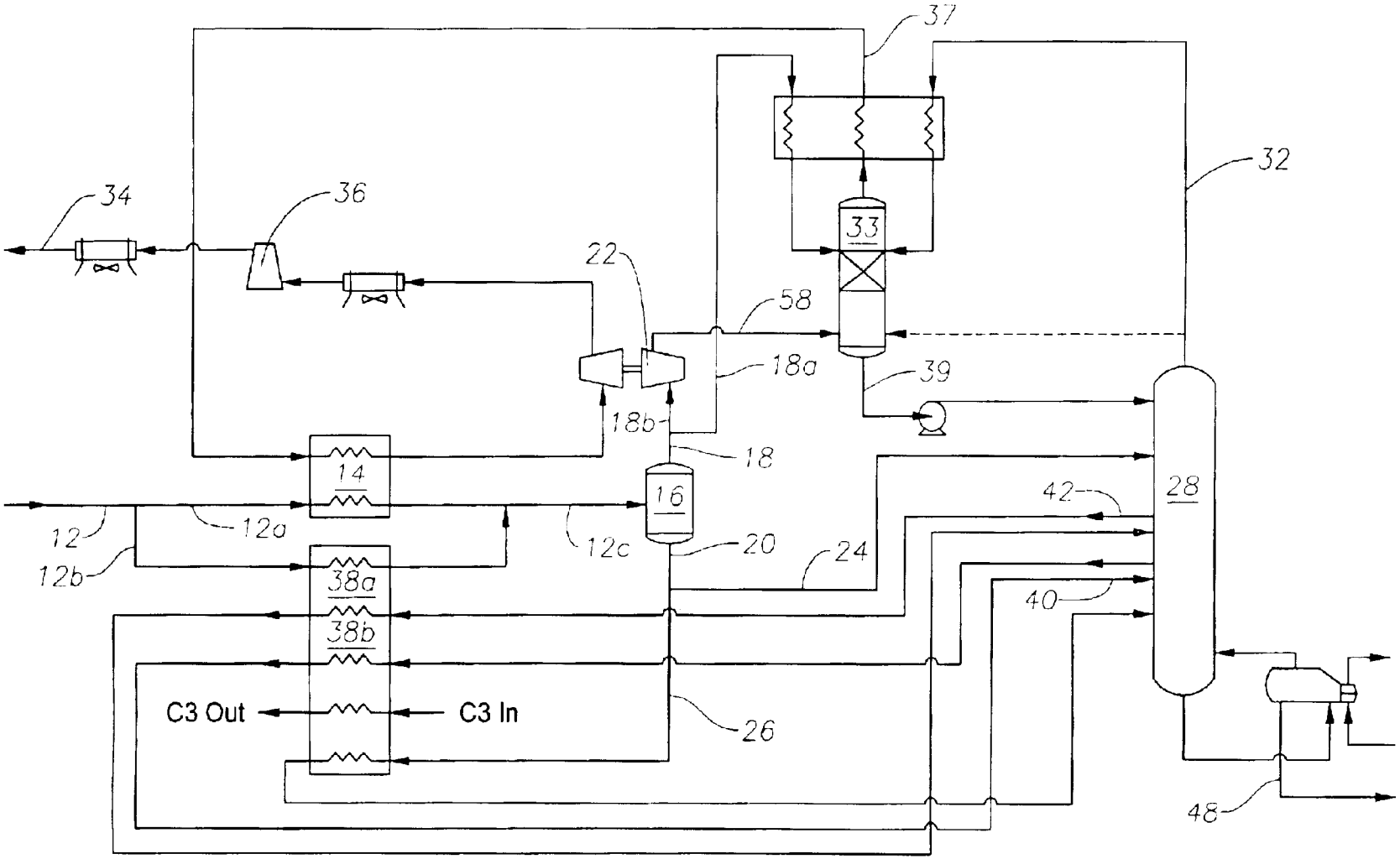
FIG. 7 is a simplified flow diagram of a cryogenic gas separation process that utilizes a dual tower, expander scheme with a split vapor stream and a single reflux stream according to an embodiment of the present invention.
Figure 8:
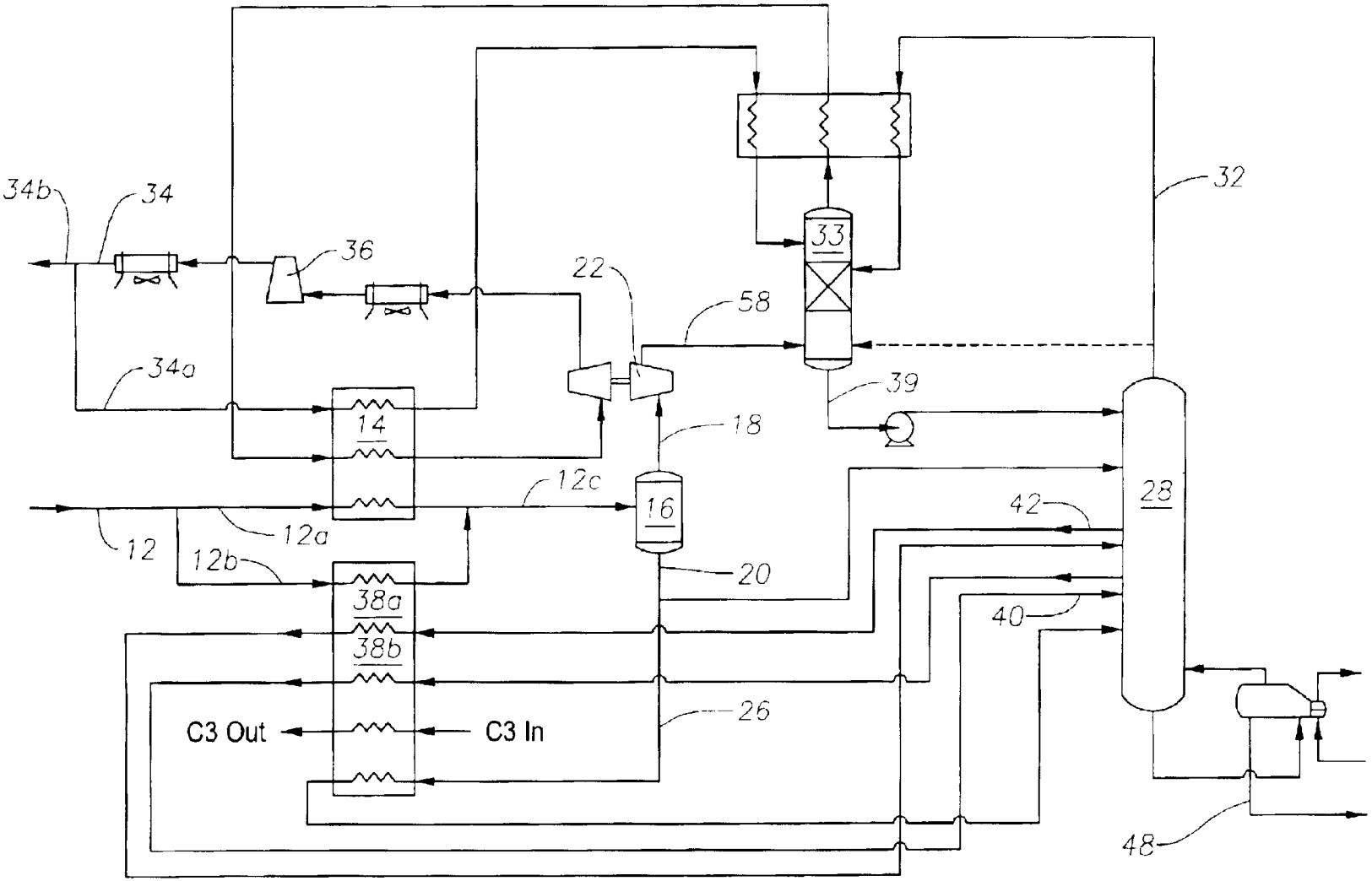
FIG. 8 is a simplified flow diagram of a cryogenic gas separation process that utilizes a residue recycle stream as a single reflux stream and dual tower scheme according to an embodiment of the present invention.

FIGS. 7–9 include embodiments of the present invention that utilize a two-tower recovery scheme. In FIG. 7, first vapor stream 18 is split into two streams, second vapor stream 18*a* and third vapor stream 18*b*. Second vapor stream 18*a* is cooled and sent to an absorber tower 33. Third vapor stream 18*b* is expanded in expander 22 and then sent to absorber tower 33 as an absorber bottoms feed stream. Absorber tower 33 produces an absorber overhead stream 37 and an absorber bottoms stream 39. Absorber overhead stream 37 is heated and boosted in pressure to form residue gas stream 34. Absorber bottoms stream 39 is sent to tower 28. Tower overhead stream 32 can be sent directly to absorber tower 33 as a bottom absorber feed stream or it can be cooled and sent to absorber tower 33 as an upper absorber feed stream. Absorber tower 33 preferably includes at least one mass transfer zone.

FIG. 8 illustrates an alternate embodiment of the two-tower scheme of the present invention. In this embodiment, first vapor stream 18 is expanded in expander 22 and sent to absorber tower 33 in its entirety. At least a portion of the residue gas stream is removed, cooled, and returned to absorber tower 33 as an absorber reflux stream 34*a*.

Another two-tower scheme embodiment is illustrated in FIG. 9. The process shown in FIG. 9 is similar to scheme shown in FIG. 2, but with the addition of the split first liquid stream 20. Second liquid stream 24 is sent to tower 28, while third liquid stream 26 is preheated and introduced towards a bottom of tower 28. This preheated stream provides stripping vapors that will strip CO2 in the tower liquid. Such stripping action will produce low CO2 containing NGL. In addition, the side reboilers 38*a*, 38*b* are moved up into tower 28 to vaporize lighter component liquid, and not allow the light ends to reach tower bottoms stream 48. Table 3 shows the simulation results for the modified scheme illustrated in FIG. 9.

TABLE 3

SIMULATION RESULTS FOR FIG. 9

| | FEED | NGL PRODUCT |
|---|---|---|
| Flow | 734.9 MMSCFD | 73241 SBPD |
| C2 (mol %) | 7.633 | 44.11 |
| (ton/day) | 2016.07 | 1713.5 |
| C3 (mol %) | 3.968 | 26.87 |
| (ton/day) | 1537 | 1530.8 |
| CO2 (mol %) | 1.5 | 1.81 |
| (ton/day) | 580.03 | 102.9 |
| Residue comp (hp) | 38110 | |
| C3 Refrig (mmbtu/hr) | 27 | |
| Plate Fin UA (Btu/° F.-hr) | 2.39E+07 | |
| C2 Recovery (%) | 85 | |
| C3 Recovery (%) | 99.6 | |
| CO2 Recovery (%) | 17.7 | |

Comparing tables 2 and 3, it can be see that for a 3.2% increase in residue compression, a 4.4% increase in exchanger area, and a 25% increase in refrigeration duty, a substantial decrease in CO2 recovery is possible. As an example, in this case, CO2 recovery drops by 49.3% or 100.16 ton/day.

In order for the base scheme shown in FIG. 2 to produce 1.81% CO2 in the NGL stream, some form of treating is required to remove CO2. This is normally performed with an amine system such as DEA. The table shown below indicates the approximate size of amine system required. Additional compression required as well as the fired reboiler duty are converted to CO2 emissions in ton/day. From the table it is evident that the new process is more efficiency in rejecting CO2 than the base process. To produce NGL with a lower CO2 level, the base process is less efficient in terms of CO2 emissions and more in capital cost as a whole amine system is required. Table 4 shows the amount of CO2 emitted for both cases, the process illustrated in FIG. 2 and the process of the present invention illustrated in FIG. 9.

TABLE 4

| | Base C2 Recovery Scheme (FIG. 2) | | Modified C2 Recovery Scheme (FIG. 9) | |
|---|---|---|---|---|
| NGL CO2, mol % | 351 | | 1.81 | |
| Compression | 42109 | | 44584 | |
| Over base case, hp | | | 2475 | |
| CO2 equiv of hp (ton/day) | | | | 27.45 |
| Final NGL CO2, mol % | 1.81 | | 1.81 | |
| Amine System required? | Yes | | No | |
| CO2 from Stripper Ovhd (ton/day) | | 102.26 | | |
| Amine, gpm | 338 | | | |
| Direct fired reboiler, MMBTU/hr | 24.32 | | | |
| Reboiler eff, % | 75 | | | |
| CO2 from Fired Reboiler (ton/day) | | 44.95 | | |
| Total CO2 emitted (ton/day) | | 147.21 | | 27.45 |

If the scheme in FIG. 9 were run, with the position of the reboilers altered, but with no stripping flow towards the bottom of the tower, there is significant reduction in CO2 levels. Results of the simulations are given in table 5.

TABLE 5

SIMULATIONS OF FIG. 9 WITH NO STRIPPING GAS

| | FEED | NGL PRODUCT |
|---|---|---|
| Flow | 734.9 MMSCFD | 73525 SBPD |
| C2 (mol %) | 7.633 | 11.11 |
| (ton/day) | 2016.07 | 1713.5 |
| C3 (mol %) | 3.968 | 26.87 |
| (ton/day) | 1537 | 1530.8 |
| CO2 (mol %) | 1.5 | 2.05 |
| (ton/day) | 580.03 | 117.5 |
| Residue comp (hp) | 38073 | |
| C3 refrig (mmbtu/hr) | 25.5 | |
| Plate Fin UA (Btu/F-hr) | 2.37E+07 | |
| C2 Recovery (%) | 85.69 | |
| C3 Recovery (%) | 99.61 | |
| CO2 Recovery (%) | 20.25 | |

Table 6 shows FIG. 9 scheme with and without stripping gas. It can be seen that the amount of CO2 vented to the atmosphere can be decreased by the addition of stripping gas. The addition of the stripping gas is primarily performed by splitting first liquid stream 20 into two liquid streams and preheating one of the liquid streams to provide the stripping gases needed to remove the CO2 from the bottom of tower 28. The cost of this modification is insignificant compared to the plant cost.

TABLE 6

PROCESS ILLUSTRATED IN FIG. 9 WITH AND WITHOUT STRIPPING GAS

| | NO STRIPPING GAS SCHEME | WITH STRIPPING GAS SCHEME |
|---|---|---|
| NGL CO2, mol % | 2.05 | 1.81 |
| Compression | 44203 | 44584 |
| Over base case, hp | | 381 |
| CO2 equiv of hp (ton/day) | | 4.23 |
| Final NGL CO2, mol % | 1.81 | 1.81 |
| Amine System Required? | Yes | No |
| CO2 from Stripper ovhd (ton/day) | 14.5 | |
| Amine GPM | 48 | |
| Direct fired reboiler, MMBTU/hr | 3.45 | |
| Reboiler eff, % | 75 | |
| CO2 from Fired Reboiler (ton/day) | 6.37 | |
| Total CO2 Emitted (ton/day) | 20.87 | |

In all embodiments of the present invention, feed stream conditions to the fractionation tower are maintained, which preferably includes maintaining an adequate quantity and temperature of the third liquid stream and an amount of reboiling for the fractionation tower. The conditions are maintained so that a quantity of CO2 in the tower bottoms stream is substantially reduced. Substantially reduced refers to a non-trivial reduction in CO2 based upon the improvements of the present invention.

In addition to the process embodiments of the present invention, an apparatus for separating an inlet gas stream into a NGL stream and a residue gas stream is also advantageously provided. The apparatus preferably includes an inlet heat exchanger for cooling an inlet gas stream to partially condense at least a portion of the inlet gas stream to produce a first vapor stream and a first liquid stream. An expander for expanding the first vapor stream to a lower pressure is also advantageously provided. The apparatus further preferably includes a fractionation tower for receiving a tower feed stream and producing a tower bottoms stream containing a less volatile hydrocarbon fraction and a tower overhead stream containing a more volatile gas fraction. At least one side reboiler is advantageously provided that removes that returns a tower reboiler stream from essentially a same theoretical stage with the fractionation tower. The side reboiler preferably heats the more volatile gas fraction higher in the fractionation tower than conventional reboilers thereby preventing the more volatile gas fraction from reaching a bottom of the fractionation tower and reducing an amount of the more volatile gas fraction recovered in the tower bottoms stream. To incorporate one of the improvements of the present invention, a splitter for splitting the first liquid stream into at least a second liquid stream and a third liquid stream is provided. The second liquid stream is preferably supplied to the fractionation tower as a second upper tower feed stream, while the third liquid stream is preferably heated and supplied to the fractionation tower at a return location at least one theoretical stage below the second upper tower feed stream. The apparatus can also include an absorber tower for receiving a first vapor stream and producing an absorber overhead stream and an absorber bottoms stream for process purposes described herein.

As an advantage of this invention, the amount of $CO_2$ recovered in an NGL cryogenic process is decreased thus minimizing or eliminating further processing and equipment. As an example, simulation data shows a reduction of $CO_2$ recovered from 10.9 mol. % to 6.0 mol. %, while increasing the ethane recovery from 73.7 mol. % to 74.2 mol. % for the base case. The base case used for comparison did not employ the split after the cold absorber, with both cases using the same residue gas compression power.

The new process can be used to either decrease CO2 in NGL, or maintain the same amount of CO2, but increase the ethane recovery levels. The process can be used in new plants or to modify existing plants.

The advantage of the new process is that due to significantly lower CO2 levels in NGL, the initial capital cost for a new plant is a lot lower as the size of the amine system is greatly reduced, or totally eliminated. In addition, the plant will vent significantly less CO2, thereby making the plant more environmentally friendly. For an existing plant, the process can be retrofitted to lower CO2 in NGL. This will reduce amine circulation, thereby reducing the amount of CO2 being vented to atmosphere. Alternately, the recovery of C2 components can be increased while still maintaining the amount of CO2 vented.

The process disclosed has two changes that need to be made to reduce the amount of CO2 in NGL over a process that has not implemented the new invention. One is to move one or more of the side reboilers higher up in the tower. The other is to split the cold separator liquid into two parts. One part is expanded and sent to the tower at the same feed location. The other part is expanded, preheated and then sent towards the bottom of the tower. The steps that are described can be carried out independent of each other. However, for maximum benefit, both are implemented simultaneously.

The process of moving reboilers up in the tower has two advantages. The first and most significant advantage is liquid higher in the tower has more light ends. Heating liquid higher in the tower preferentially vaporizes the light ends, and prevents them from reaching the bottom of the tower. This prevents buildup of CO2 in the NGL product. The other advantage of moving the side reboilers up in that the liquid is colder. This cold liquid improves temperature approach in the cooling train thereby improving efficiency. A redistribution of reboiler duties is required to optimize the cooling curves.

The other change that can be made to the process is to split the cold separator liquid into two streams. One part is expanded in pressure across a control valve and sent to the same feed location as before. However, the other stream is flashed to a lower pressure in order to cool it. This cooled stream is preheated, normally against warm feed gas and then sent towards the bottom of the tower. Preheating the liquid generates vapors that act as stripping vapor in the tower. Hydrocarbon liquid that is falling down the tower has some CO2 in it. Vapor in the preheated feed stream tends to act as stripping vapor reducing the CO2 in the downward falling liquid. It should be noted that due to the introduction of hot stream at the bottom of the tower, and the fact that there is less CO2 in the NGL, the bottom of the tower runs warmer than before. This might require that the side reboilers be moved up to maintain adequate temperature approaches in the cooling train. The decision of moving the reboilers higher in the towers with this modification depends on the cooling train temperature approaches, and may not always be required.

While the invention has been shown or described in only some of its forms, it should be apparent to those skilled in the art that it is not so limited, but is susceptible to various changes without departing from the scope of the invention.

For example, various means of heat exchange can be used to supply the reboilers with heat. A single draw from the bottom can be used as an alternative to the two streams shown in FIG. 1. The reboiler can be more than one exchanger or be a single multi-pass exchanger. Equivalent types of reboilers will be known to those skilled in the art.

We claim:

1. A process for separating an inlet gas stream containing methane, C2 components, C3 components and heavier hydrocarbons into a volatile gas fraction containing substantially all the methane and a less volatile hydrocarbon fraction containing a large portion of the C2+ components, the process comprising the steps of:

supplying and cooling an inlet gas stream having a quantity of CO2 such that at least a portion of the inlet gas stream is condensed to produce a first vapor stream and a first liquid stream;

expanding the first vapor stream to a lower pressure, and then supplying a fractionation tower with the vapor stream as a tower feed stream so that the fractionation tower produces a tower bottoms stream containing a less volatile hydrocarbon fraction and a tower overhead stream containing a volatile gas fraction; and the improvement comprising:

splitting the first liquid stream into at least a second liquid stream and a third liquid stream;

supplying the fractionation tower with the second liquid stream as a second upper tower food stream; and heating the third liquid stream and supplying the fractionation tower with the third liquid stream at a return location at least one theoretical stage below the second upper tower feed stream, the third liquid stream providing stripping vapors to remove CO2 from the liquid descending down the fractionation tower such that the quantity of CO2 is significantly reduced in the less volatile hydrocarbon fraction or ethane is significantly increased while the quantity of CO2 is substantially maintained in the less volatile hydrocarbon fraction.

2. A process for separating as inlet gas stream containing methane, C2 components, C3 components and heavier hydrocarbons into a volatile gas fraction containing substantially all the methane end a less volatile hydrocarbon fraction containing a large portion of the C2+ components, the process comprising the steps of:

supplying and cooling an inlet gas stream having a quantity of CO2 to partially condense at least a portion of the inlet gas stream to produce a first vapor stream and a first liquid stream;

expanding the first vapor stream to a lower pressure, and then supplying a fractionation tower with the vapor stream as a tower feed stream so that the fractionation tower produces a tower bottoms stream containing a less volatile hydrocarbon fraction and a tower overhead stream containing a volatile gas fraction; and the improvement comprising:

splitting the first liquid stream into at least a second liquid stream and a third liquid stream;

supplying the fractionation tower with the second liquid stream as a second upper tower feed stream;

heating the third liquid stream and supplying the fractionation tower with the third liquid stream at a return location at least one theoretical stage below the second upper tower feed stream, the third liquid stream providing stripping vapors capable of removing CO2 from the liquid descending down the fractionation tower such that the quantity of CO2 is significantly reduced in the less volatile hydrocarbon fraction or ethane is significantly increased while the quantity of CO2 is substantially maintained in the less volatile hydrocarbon fraction; and maintaining feed stream conditions including maintaining an adequate quantity and temperature of the third liquid stream and an amount of reboiling for the functionation tower so that a quantity of carbon dioxide in the tower bottoms stream is substantially reduced.

3. The process of claim 1, wherein the step of supplying and cooling the inlet gas stream includes cooling at least a portion of the inlet gas stream by heat exchange contact with the third liquid stream.

4. The process of claim 3, wherein the step of cooling at least a portion of the inlet gas stream further includes cooling at least a portion of the inlet gas stream by heat exchange contact with the third liquid stream and at least one tower reboiler stream, the at least one tower reboiler stream being removed from the fractionation tower at a removal location and being returned at a return location located at essentially a same theoretical stage within the fractionation tower as the removal location.

5. The process of claim 1, wherein the step of expanding the first vapor stream to a lower pressure further includes the steps of:

supplying an expander outlet separator with the first vapor stream and the tower overhead stream thereby forming a separator bottoms stream and a separator overhead stream;

supplying the fractionation tower with the separator bottoms stream as the tower feed stream; and heating and boosting in pressure the separator overhead stream to form a residue gas stream.

6. The process of claim 5, wherein the step of healing and boosting in pressure the separator overhead stream to form a residue gas stream includes heating the separator overhead stream by heat exchange contact with at least a portion of the inlet gas stream.

7. The process of claim 1, further comprising the steps of:

heating and boosting in pressure the tower overhead stream to form a residue gas stream;

removing at least a portion of the residue gas stream and cooling at least a portion of the residue gas stream to substantially condense at least a portion of the tower overhead stream; and supplying the fractionation tower with the at least a portion of the substantially condensed tower overhead stream as a top tower feed stream.

8. The process of claim 7, wherein the step of heating and boosting in pressure the tower overhead stream to form a residue gas stream includes heating the tower overhead stream by heat exchange contact with a stream selected from the group consisting of at least a portion of the inlet gas stream, at least a portion of the residue gas stream, and combinations thereof.

9. The process of claim 7, wherein the step of cooling at least a portion of the inlet gas stream further includes cooling at least a portion of the inlet gas stream by heat exchange contact with the third liquid stream and at least one tower reboiler stream, the at least one tower reboiler stream being removed from the fractionation tower at a removal location and being returned at a return location located at essentially a same theoretical stage within the fractionation tower as the removal location.

10. A process for separating an inlet gas stream containing methane, C2 components, C3 components and heavier hydrocarbons, into a residue gas stream containing substantially all the methane and more volatile components and a less volatile hydrocarbon stream containing C2 components, C3 and heavier components, the process comprising steps of:

supplying and cooling an inlet gas stream having a quantity of CO2 to partially condense at least a portion of the inlet gas stream to produce a first vapor stream and a first liquid stream;

splitting at least a portion of the first vapor stream into a second vapor stream a third vapor stream;

cooling, expanding, and then supplying the fractionation tower with the second vapor stream as a first upper tower feed stream;

expanding the third vapor stream and supplying the fractionation tower with the third vapor stream as a second upper tower feed stream so that the fractionation tower produces a tower bottoms stream containing a less volatile hydrocarbon stream and a tower overhead stream containing a more volatile fraction; and an improvement to the process comprising the steps of:

splitting the first liquid stream into at least a second liquid stream and a third liquid stream;

supplying the fractionation tower with the second liquid stream as a middle feed stream; and heating the third liquid stream and supplying the third liquid stream to the fractionation tower at a location at learnt one theoretical stage below the middle feed stream, the third liquid stream providing stripping vapors to remove CO2 from the liquid descending down the fractionation tower such that the quantity of CO2 as significantly reduced in the less volatile hydrocarbon fraction or ethane is significantly increased while the quantity of CO2 is substantially maintained in the less volatile hydrocarbon fraction.

11. A process for separating an inlet gas stream containing methane, C2 components, C3 components and heavier hydrocarbons, into a residue gas stream containing substantially all the methane and more volatile components and a less volatile hydrocarbon stream containing C2 components, C3 and heavier components, the process comprising steps of:

supplying and cooling an inlet gas stream having a quantity of CO2 to partially condense at least a portion of the inlet gas stream to produce a first vapor stream and a first liquid stream;

splitting at least a portion of the first vapor stream into a second vapor stream and a third vapor stream;

cooling, expanding, and then supplying the fractionation tower with the second vapor stream as a first upper tower feed stream;

expanding the third vapor stream and supplying the fractionation tower with the third vapor stream as a second upper tower feed stream so that the fractionation tower produces a tower bottoms stream containing a less volatile hydrocarbon stream and a tower overhead stream containing a more volatile fraction; and an improvement to the process comprising the step of:

splitting the first liquid stream into at least a second liquid stream and a third liquid stream;

supplying the fractionation tower with the second liquid stream as a middle feed stream;

heating the third liquid stream and supplying the third liquid stream to the fractionation tower at a location at least one theoretical stage below the middle feed stream, the third liquid stream providing stripping vapors capable of removing CO2 from the liquid descending down the fractionation tower such that the quantity of CO2 is significantly reduced in the less volatile hydrocarbon fraction or ethane is significantly increased while the quantity of CO2 is substantially maintained in the less volatile hydrocarbon fraction; and maintaining feed stream conditions including maintaining an adequate quantity and temperature of the third liquid stream and an amount of reboiling for the fractionation tower so that a quantity of carbon dioxide in the tower bottoms stream is substantially reduced.

12. The process of claim 10, further including heating and boosting in pressure the tower overhead stream to form a residue gas stream.

13. The process of claim 10, wherein the step of supplying and cooling the inlet gas stream includes cooling at least a portion of the inlet gas stream by heat exchange contact with the third liquid steam.

14. The process of claim 13, wherein the step of cooling at least a portion of the inlet gas stream further includes cooling at least a portion of the inlet gas stream by heat exchange contact with the third liquid stream and at least one tower reboiler stream, least one tower reboiler stream being removed from the fractionation tower at a removal location and being returned at a return location located at essentially a same theoretical stage within the fractionation tower as the removal location.

15. The process of claim 10, further including the step of cooling the second vapor stream to partially condense at least a portion of the second vapor stream to form a separator overhead steam and a separator bottoms stream.

16. The process of claim 11, further comprising the steps of:

heating and boosting in pressure the tower overhead stream to form a residue gas stream;

removing and cooling at least a portion of the residue gas stream to substantially condense the at least a portion of the residue gas stream; and supplying the fractionation tower with the at least a portion of the residue gas stream as a top tower food stream.

17. The process of claim 16, wherein the step of heating and boosting in pressure the tower overhead stream to form a residue gas stream includes heating the tower overhead stream by heat exchange contact with a stream selected from the group consisting of the second vapor stream, at least a portion of the inlet gas stream, and combinations thereof.

18. A process for separating an inlet gas stream containing methane, C2 components, C3 components and heavier hydrocarbons, into a residue gas stream containing substantially all the methane and more volatile components and a less volatile hydrocarbon stream containing C2 components, C3 and heavier components, the process comprising steps of:

supplying and cooling an inlet gas stream having a quantity of CO2 to partially condense at least a portion of the inlet gas stream to produce a first vapor stream and a first liquid stream;

splitting at least a portion of the first vapor stream into a second vapor stream and a third vapor stream;

cooling the second vapor stream to substantially condense the second vapor stream and supplying the second vapor stream to an absorber tower as an absorber top feed stream;

expanding the third vapor stream to a lower pressure and then supplying the absorber tower with the third vapor stream as an absorber bottoms feed stream so that the absorber tower produces an absorber overhead stream containing a more volatile fraction of the second and third vapor streams and an absorber bottoms stream containing a less volatile fraction of the second and third vapor streams;

supplying a fractionation tower with the absorber bottoms stream as a top tower feed stream so that the fractionation tower produces a tower bottom stream containing a less volatile hydrocarbon fraction of the inlet gas stream and a tower overhead stream containing a more volatile fraction of the inlet gas stream;

supplying the absorber tower with the tower overhead stream; and an improvement to the process comprising the steps of:

dividing the first liquid stream into at least a second liquid stream and a third liquid stream;

supplying the fractionation tower with the second liquid stream as a lower tower feed stream; and healing and then supplying the fractionation tower with the third liquid stream at a location at least one theoretical stage below the lower tower feed stream, the third liquid stream providing stripping vapors to remove CO2 from the liquid descending down the fractionation tower such that the quantity of CO2 is significantly reduced in the less volatile hydrocarbon fraction or ethane is significantly increased while the quantity of CO2 is substantially maintained in the less volatile hydrocarbon fraction.

19. A process for separating an inlet gas stream containing methane, C2 components, C3 components and heavier hydrocarbons, into a residue gas stream containing substantially all the methane and more volatile components and a less volatile hydrocarbon strewn containing C2 components, C3 and heavier components, the process comprising steps of:

supplying and cooling an inlet gas stream having a quantity of CO2 to partially condense at least a portion of the inlet gas stream to produce a first vapor stream and a first liquid stream;

splitting at least a portion of the first vapor stream into a second vapor stream and a third vapor stream;

cooling the second vapor stream to substantially condense the second vapor stream and supplying the second vapor stream to an absorber tower as an absorber top feed stream;

expanding the third vapor stream to a lower pressure and then supplying the absorber tower with the third vapor stream as an absorber bottoms feed stream so that the absorber tower produces an absorber overhead stream containing a more volatile function of the second and third vapor streams and an absorber bottoms stream containing a less volatile fraction of the second and third vapor streams;

supplying a fractionation tower with the absorber bottoms stream as a top tower feed stream so that the fractionation tower produces a tower bottoms stream containing a less volatile hydrocarbon fraction of the inlet gas stream and a tower overhead stream containing a more volatile fraction of the inlet gas stream;

supplying the absorber tower with the tower overhead stream; and an improvement to the process comprising the steps of:

dividing the first liquid stream into at least a second liquid stream and a third liquid stream;

supplying the fractionation tower with the second liquid stream as a lower tower feed stream;

heating and that supplying the fractionation tower with the third liquid stream at a location at least one theoretical stage below the lower tower feed stream, the third liquid stream providing stripping vapors capable of removing CO2 from the liquid descending down the fractionation tower such that the quantity of CO2 is significantly reduced in the less volatile hydrocarbon fraction or ethane is significantly increased while the quantity of CO2 is substantially maintained in the less volatile hydrocarbon fraction; and maintaining feed stream conditions including maintaining an adequate quantity and temperature of the third liquid stream and an amount of reboiling for the fractionation tower so that a quantity of carbon dioxide in the tower bottoms stream is substantially reduced.

20. The process of claim 18, wherein the step of supplying the absorber tower with the tower overhead stream includes supplying the absorber tower with the tower overhead stream at a lower absorber feed position.

21. The process of claim 18, wherein the step of supplying the absorber tower with the tower overhead stream includes cooling and at least partially condensing the tower overhead stream and supplying the absorber tower at a second absorber top feed position.

22. The process of claim 18, further including heating and boosting in pressure the absorber overhead stream to form a residue gas stream.

23. The process of claim 22, wherein the step of heating and boosting in pressure the absorber overhead stream to form a residue gas stream includes the step of heating the absorber overhead stream by heat exchange contact with a stream selected from the group consisting of the tower overhead stream, the second vapor stream, at least a portion of the inlet gas stream, and combinations thereof.

24. The process of claim 18, wherein the step of supplying and cooling the inlet gas stream includes the step of cooling at least a portion of the inlet gas stream by heat exchange contact with the third liquid stream and at least one tower reboiler stream, the at least one tower reboiler stream being removed from the fractionation tower at a removal location and being returned at a return location located at essentially a same theoretical stage within the fractionation tower as the removal location.

25. A process for separating an inlet gas stream containing methane, C2 components, C3 components and heavier hydrocarbons, into a residue gas stream containing substantially all the methane and more volatile components and a less volatile hydrocarbon stream containing C2 components, C3 and heavier components, the process comprising steps of:

supplying and cooling the inlet gas stream having a quantity of CO2 to partially condense at least a portion of the inlet gas stream to produce a first vapor stream and a first liquid stream;

expanding the first vapor stream to a lower pressure, and then supplying an absorber tower with the first vapor stream as an absorber bottom feed stream so that the absorber tower produces an absorber overhead stream and an absorber bottoms stream;

supplying the absorber bottoms stream to a fractionation tower as top tower feed stream so that the fractionation tower produces a tower overhead stream and a tower bottoms stream;

heating and boosting in pressure the absorber overhead stream to form a residue gas stream;

removing and then cooling at least a portion of the residue gas stream so that the at least a portion of the residue gas stream is substantially condensed;

supplying the absorber tower with the at least a portion of the residue gas stream as a top absorber feed stream;

supplying the absorber tower with the tower overhead stream; and an improvement to the process comprising the steps of:

dividing the first liquid stream into at least a second liquid stream and a third liquid stream;

supplying fractionation tower with the second liquid stream as a first lower tower feed stream; and heating and then supplying the fractionation tower with the third liquid stream at a location at least one theoretical stage below the first lower tower feed stream, the third liquid stream providing stripping vapors to remove CO2 from the liquid descending down the fractionation tower such that the quantity of CO2 is significantly reduced in the less volatile hydrocarbon fraction or ethane is significantly increased while the quantity of CO2 is substantially maintained in the less volatile hydrocarbon fraction.

26. A process for separating an inlet gas stream containing methane, C2 components, C3 components and heavier hydrocarbons, into a residue gas stream containing substantially all the methane and more volatile components and a less volatile hydrocarbon stream containing C2 components, C3 and heavier components, the process comprising steps of:

supplying and cooling the inlet gas stream having a quantity of CO2 to partially condense at least a portion of the inlet gas stream to produce a first vapor stream and a first liquid stream;

expanding the first vapor stream to a lower pressure, and then supplying an absorber tower with the first vapor stream as an absorber bottom feed stream so that the absorber tower produces an absorber overhead stream and an absorber bottoms stream;

supplying the absorber bottoms stream to a fractionation tower as top tower feed stream so that the fractionation tower produces a tower overhead stream and a tower bottoms stream;

heating and boosting in pressure the absorber overhead stream to turn a residue gas stream;

removing and then cooling at least a portion of the residue gas stream so that the at least a portion of the residue gas stream is substantially condensed;

supplying the absorber tower with the at least a portion of the residue gas stream as a top absorber feed stream;

supplying the absorber tower with the tower overhead stream; and an improvement to the process comprising the steps of:

dividing the first liquid stream into at least a second liquid stream and a third liquid stream;

supplying fractionation tower with the second liquid stream as a first lower tower feed stream;

heating and than supplying the fractionation tower with the third liquid stream at a location at least one theoretical stage below the first lower tower feed stream, the third liquid stream providing stripping vapor capable of removing CO2 from the liquid descending down the fractionation tower such that the quantity of CO2 is significantly reduced in the less volatile hydrocarbon fraction or ethane is significantly increased while the quantity of CO2 is substantially maintained in the less volatile hydrocarbon fraction; and maintaining feed stream conditions including maintaining an adequate quantity and temperature of the third liquid stream and an amount of reboiling for the fractionation tower so that a quantity of carbon dioxide in the tower bottoms stream is substantially reduced.

27. The process of claim 25, wherein the step of supplying the absorber tower with the tower overhead stream includes supplying the absorber tower with the tower overhead stream at a lower absorber feed position.

28. The process of claim 25, wherein the step of supplying the absorber tower with the tower overhead stream includes cooling and at least partially condensing the tower overhead stream and supplying the absorber tower at an upper absorber feed position.

29. The process of claim 25, wherein the step of supplying the cooling the inlet gas stream includes cooling at least a portion of the inlet gas stream by heat exchange contact with the third liquid stream and at least one tower reboiler stream, the at least one tower reboiler stream being removed from the fractionation tower at a removal location and being returned at a return location located at essentially a same theoretical stage within the fractionation tower as the removal location.

30. The process of claim 25, wherein the step of heating and boosting in pressure the absorber overhead stream to form a residue gas stream includes heating the absorber overhead stream by heat exchange contact with a stream selected from the group consisting of the tower overhead stream, the at least a portion of the residue gas stream, the at least a portion of the inlet gas stream, and combinations thereof.

31. The process of claim 25, wherein the step of supplying an absorber tower with the first vapor stream includes supplying an absorber tower having at least one mass transfer zone contained therein with the first vapor stream.

32. A process for separating an inlet gas stream containing methane, C2 components, C3 components and heavier hydrocarbons, into a residue gas stream containing substantially all the methane and more volatile components and a less volatile hydrocarbon stream containing C2 components, C3 and heavier components, the process comprising steps of:

supplying and cooling the inlet gas stream having a quantity of CO2 to partially condense at least a portion of the inlet gas stream to produce a first vapor stream and a first liquid stream;

dividing the first vapor stream into a second vapor stream and a third vapor stream;

cooling and at least partially condensing the second vapor stream thereby forming a flash separator bottoms stream and a flash separator overhead stream and expanding the third vapor stream;

cooling the flash separator overhead stream and supplying an absorber tower with the flash separator overhead stream as a first upper absorber feed stream, the flash separator bottoms stream a first lower absorber feed stream, and the third vapor stream as a second lower absorber feed stream to thereby produce an absorber overhead stream and an absorber bottoms stream;

supplying a fractionation tower with the absorber bottoms stream as an upper tower feed stream to thereby produce a tower overhead stream and a tower bottoms stream;

heating and boosting in pressure the absorber overhead stream to form a residue gas stream;

removing and cooling at least a portion of the residue gas stream so that the at least a portion of the residue gas stream is substantially condensed;

supplying the absorber tower with the tower overhead stream and the at least a portion of the residue gas stream as a second upper absorber feed stream; and an improvement to the process comprising the steps of:

dividing the first liquid stream into at last a second liquid stream and a third liquid stream;

supplying the fractionation tower with the second liquid stream; and heating and supplying the fractionation tower with the third liquid stream at a location at least one theoretical stage below the second liquid stream, the third liquid stream providing stripping vapors to remove CO2 from the liquid descending down the fractionation tower such that the quantity of CO2 is significantly reduced in the less volatile hydrocarbon fraction or ethane is significantly increased while the quantity of CO2 is substantially maintained in the less volatile hydrocarbon fraction.

33. A process for separating an inlet gas stream containing methane, C2 components, C3 components and heavier hydrocarbons, into a residue gas stream containing substantially all the methane and more volatile components and a less volatile hydrocarbon stream containing C2 components, C3 and heavier components, the process comprising steps of:

supplying and cooling the inlet gas stream having a quantity of CO2 to partially condense at least a portion of the inlet gas stream to produce a first vapor stream and a first liquid stream;

dividing the first vapor stream into a second vapor stream and a third vapor stream;

cooling and at least partially condensing the second vapor stream thereby forming a flash separator bottoms stream and a flash separator overhead stream and expanding the third vapor stream;

cooling the flash separator overhead stream and supplying an absorber tower with the flash separator overhead stream as a first upper absorber feed stream, the flash separator bottoms stream as a first lower absorber feed stream, and the third vapor stream as a second lower absorber feed stream to thereby produce an absorber overhead stream and an absorber bottoms stream;

supplying a fractionation tower with the absorber bottoms stream as an upper tower feed stream to thereby produce a tower overhead stream and a tower bottoms stream;

heating and boosting in pressure the absorber overhead stream to form a residue gas stream;

removing and cooling at least a portion of the residue gas stream so that the at least a portion of the residue gas stream is substantially condensed;

supplying the absorber tower with the tower overhead stream and the at least a portion of the residue gas stream as a second upper absorber feed stream; and an improvement to the process comprising the steps of;

dividing the first liquid stream into at least a second liquid stream and a third liquid stream;

supplying the fractionation tower with the second liquid stream;

heating and supplying the fractionation tower with the third liquid stream at a location at least one theoretical stage below the second liquid stream, the third liquid stream providing stripping vapors capable of removing CO2 from the liquid descending down the fractionation tower such that the quantity of CO2 is significantly reduced in the less volatile hydrocarbon fraction or ethane is significantly increased while the quantity of CO2 is substantially maintained in the less volatile hydrocarbon fraction; and maintaining feed stream conditions including maintaining an adequate quantity and temperature of the third liquid stream and an amount of rebelling for the fractionation tower so that a quantity of carbon dioxide in the tower bottoms stream is substantially reduced.

34. The process of claim 32, wherein the step of supplying the absorber tower with the tower overhead stream includes supplying the absorber tower with the tower overhead stream at a tower absorber feed position.

35. The process of claim 32, wherein the step of supplying the absorber tower with the tower overhead stream includes cooling and at least partially condensing the tower overhead stream and supplying the absorber tower at an upper absorber feed position.

36. The process of claim 32, wherein the step of supplying and cooling the inlet gas stream includes cooling at least a portion of the inlet gas stream by heat exchange contact with the third liquid stream and at least one tower reboiler stream, the at least one tower reboiler stream being removed from the fractionation tower at a removal location and being returned at a return location located at essentially a same theoretical stage within the fractionation tower as the removal location.

37. The process of claim 32, wherein the step of heating and boosting in pressure the absorber overhead stream to form a residue gas stream includes heating the absorber overhead stream by heat exchange contact with a stream selected from the group consisting of the tower overhead stream, the at least a portion of the residue gas stream, the at least a portion of the inlet gas stream, the second vapor stream, the flash separator overhead stream, and combinations thereof.

38. The process of claim 32, wherein the step of supplying absorber tower with the flash separator overhead stream includes supplying an absorber tower having at least one mass transfer zone contained therein with the flash separator overhead stream.

39. An apparatus for separating an inlet gas stream containing methane, C2 components, C3 components and heavier hydrocarbons, into a residue gas stream containing substantially all the methane and more volatile components and a less volatile hydrocarbon stream containing C2 components, C3 and heavier components, the apparatus comprising:

an inlet heat exchanger for cooling an inlet gas stream having a quantity of CO2 to partially condense at least a portion of the inlet gas stream to produce a first vapor stream and a first liquid stream;

an expander for expending the first vapor stream to a lower pressure;

a fractionation tower for receiving a tower feed stream and producing a tower bottoms stream containing a less volatile hydrocarbon fraction and a tower overhead stream containing a more volatile gas fraction;

at least one side reboiler that removes that returns a tower reboiler stream from essentially a same theoretical stage with the fractionation tower, the side reboiler heats the more volatile gas fraction higher in the fractionation tower thereby preventing the more volatile gas fraction from reaching a bottom of the fractionation tower and reducing an amount of the more volatile gas fraction recovered in the tower bottoms stream; and a splitter for splitting the first liquid stream into at least a second liquid stream and a third liquid stream, the second liquid stream being supplied to the fractionation tower as a second upper tower feed stream and the third liquid stream being heated and supplied to the fractionation lower at a return location at least one theoretical stage below the second upper tower feed stream, the third liquid stream providing stripping vapors to remove CO2 from the liquid descending down the fractionation tower such that the quantity of CO2 is significantly reduced in the less volatile hydrocarbon fraction or ethane is significantly increased while the quantity of CO2 is substantially maintained in the less volatile hydrocarbon fraction.

40. The apparatus of claim 39, further including an absorber tower for receiving a first vapor stream and producing an absorber overhead stream and an absorber bottoms stream.

* * * * *

UNITED STATES PATENT AND TRADEMARK OFFICE

CERTIFICATE OF CORRECTION

PATENT NO. : 6,823,692 B1
DATED : November 30, 2004
INVENTOR(S) : Sanjiv Patel, Justin Pan and Jorge Foglietta It is certified that error appears in the above-identified patent and that said Letters Patent is hereby corrected as shown below:

Column 10,
Line 20, change “see” to -- seen --

Column 14,
Line 1, change “as” to -- and --
Line 4, change “end” to -- and --
Line 36, change “fuctionation” to -- fractionation --
Line 63, change “healing” to -- heating --

Column 15,
Line 40, after first occurrence “stream” insert -- and --
Line 57, change “learnt” to -- least --
Line 61, change “as” to -- is --

Column 16,
Line 55, after “stream,” insert -- as --
Line 63, change “steam” to -- stream --

Column 17,
Line 5, change “food” to -- feed --
Line 52, change “healing” to -- heating --
Line 65, change “strewn” to -- stream --

Column 18,
Line 15, change “function” to -- fraction --
Line 34, change “that” to -- then --

Column 20,
Line 9, change “turn” to -- form --
Line 23, change “than” to -- then --
Line 26, change “vapor” to -- vapors --
Line 48, change “the” to -- and --

Column 21,
Line 21, after “stream” insert -- as --
Line 39, change “last” to -- least --

UNITED STATES PATENT AND TRADEMARK OFFICE

CERTIFICATE OF CORRECTION

PATENT NO. : 6,823,692 B1 
DATED : November 30, 2004
INVENTOR(S) : Sanjiv Patel, Justin Pan and Jorge Foglietta It is certified that error appears in the above-identified patent and that said Letters Patent is hereby corrected as shown below:

Column 22,
Line 23, change ";" to -- : --
Line 41, change "rebelling" to -- boiling --

Column 23,
Line 4, after "supplying" insert -- an --
Line 21, change "expending" to -- expanding --

Column 24,
Line 14, change "lower" to -- tower --

Signed and Sealed this

Third Day of May, 2005

JON W. DUDAS
*Director of the United States Patent and Trademark Office*